US005211443A

United States Patent [19]

Kelly

[11] Patent Number: 5,211,443

[45] Date of Patent: May 18, 1993

[54] LOUNGE CHAIR

[75] Inventor: Gordon D. Kelly, Elm Grove, Wis.

[73] Assignee: Bemis Manufacturing Company, Sheboygan Falls, Wis.

[21] Appl. No.: 751,804

[22] Filed: Aug. 29, 1991

[51] Int. Cl.[5] ..... A47C 4/00; A47D 1/62

[52] U.S. Cl. ..... 297/56; 297/443; 297/31

[58] Field of Search ..... 297/114, 356, 357, 396, 297/403, 408, 21-27, 31, 34, 46, 47, 56, 55, 443

[56] References Cited

U.S. PATENT DOCUMENTS

| | | | |
|---|---|---|---|
| Re. 17,755 | 7/1930 | Graham . | |
| 116,271 | 6/1871 | Collignon et al. . | |
| 162,447 | 4/1875 | Wilson . | |
| 270,224 | 1/1883 | Johnson et al. . | |
| 271,857 | 2/1883 | Johnson et al. . | |
| 431,389 | 7/1890 | Peard . | |
| 722,855 | 3/1902 | Koehn . | |
| 955,094 | 4/1910 | McNeel . | |
| 1,342,650 | 6/1920 | Schlegel . | |
| 1,615,246 | 1/1927 | Tasman . | |
| 1,694,933 | 12/1928 | Walker et al. | 297/31 |
| 1,729,687 | 10/1929 | Savage . | |
| 1,849,017 | 3/1932 | Oliver . | |
| 1,888,160 | 11/1932 | Craven . | |
| 1,921,622 | 8/1933 | Korth . | |
| 2,310,346 | 2/1943 | Bell . | |
| 2,449,747 | 9/1948 | Kramer . | |
| 2,523,452 | 9/1950 | Shively . | |
| 2,727,563 | 12/1955 | Cook . | |
| 2,787,316 | 4/1957 | Moore et al. . | |
| 3,123,396 | 3/1964 | Searle | 297/114 |
| 3,138,400 | 6/1964 | Reid . | |
| 3,174,799 | 3/1965 | Haltenberger . | |
| 3,316,014 | 4/1967 | Barecki . | |
| 3,331,633 | 7/1967 | Kovacevich . | |
| 3,385,632 | 5/1968 | Scelzi . | |
| 4,252,367 | 2/1981 | Vanderminden . | |
| 4,341,417 | 7/1982 | Deconinck . | |
| 4,458,941 | 7/1984 | Venable . | |
| 4,521,045 | 6/1985 | Deconinck . | |
| 4,525,009 | 6/1985 | De la Sota Marteniz . | |
| 4,711,494 | 12/1987 | Duvenkamp . | |
| 4,906,042 | 3/1990 | Ollat . | |

*Primary Examiner*—Kenneth J. Dorner
*Assistant Examiner*—James M. Gardner
*Attorney, Agent, or Firm*—Michael, Best & Friedrich

[57] ABSTRACT

A chair comprising a seat, and a backrest including a lower portion which is connected to the seat and which has an upper end, a rear surface, and a forwardly facing lower body supporting surface, an upper portion having a lower end, an upper body supporting surface, and a surface opposite the upper body supporting surface, and structure connecting the lower end of the upper portion to the upper end of the lower portion for translational movement relative thereto between a locked position wherein the upper and lower body supporting surfaces are generally coplanar, and an intermediate position spaced upwardly from the locked position, and for pivotal movement relative thereto between the intermediate position and a folded-up position wherein the rear surface of the lower portion and the opposite surface of the upper portion are substantially in abutment.

6 Claims, 6 Drawing Sheets

LOUNGE CHAIR

BACKGROUND OF THE INVENTION

The invention relates to furniture, and more particularly to leisure furniture such as lounge chairs or beach chairs. The invention also relates to furniture made of injection-molded plastic.

A known lounge chair comprises a seat member and a backrest member connected for relative pivotal movement about an axis that is horizontal when the chair is in use. The rearward end of the seat member forms the back legs of the chair, and the forward end of the backrest member forms the front legs of the chair. The chair can be folded up so that the upper surface of the seat member and the front surface of the backrest member are substantially in abutment.

It is also known to provide a lounge chair with the position of the backrest relative to the seat being adjustable.

SUMMARY OF THE INVENTION

The invention provides a lounge chair that is adjustable, that folds up for easy transportation and storage, that is strong and durable, and that has an extendable backrest providing support for the upper back and even the head of the user.

More particularly, the invention provides a chair comprising a seat, and a backrest including a lower portion which is connected to the seat and which has an upper end, a rear surface, and a forwardly facing lower body supporting surface, an upper portion having a lower end, an upper body supporting surface, and a surface opposite the upper body supporting surface, and means connecting the lower end of the upper portion to the upper end of the lower portion for translational movement relative thereto between a locked position wherein the upper and lower body supporting surfaces are generally coplanar, and an intermediate position spaced upwardly from the locked position, and for pivotal movement relative thereto between the intermediate position and a folded-up position wherein the rear surface of the lower portion and the opposite surface of the upper portion are substantially in abutment.

One embodiment of the invention provides a chair comprising a seat having an upper surface, a backrest including a lower portion having an upper end, a rear surface, and a forwardly facing lower body supporting surface, an upper portion having a lower end, an upper body supporting surface, and a surface opposite the upper body supporting surface, and means connecting the lower end of the upper portion to the upper end of the lower portion for movement relative thereto between a locked position wherein the upper and lower body supporting surfaces are generally coplanar, and a folded-up position wherein the rear surface of the lower portion and the opposite surface of the upper portion are substantially in abutment, and means connecting the lower portion of the backrest to the seat for movement relative thereto between a folded-up position wherein the upper surface of the seat and the lower body supporting surface of the lower portion of the backrest are substantially in abutment, and a seating position wherein the upper surface of the seat is transverse to the lower body supporting surface of the lower portion of the backrest.

One embodiment of the invention provides a chair comprising a seat, and a backrest which is connected to the seat and which includes a first portion including a first body supporting surface, a second portion including a second body supporting surface, means pivotally connecting the second portion to the first portion for movement about a generally horizontal axis and relative to a first position wherein the second surface is generally coplanar with the first surface, and means for releasably retaining the second portion in the first position.

One embodiment of the invention provides a chair comprising a seat having an integrally formed leg part, a backrest including an integrally formed leg part cooperating with the leg part of the seat to support the chair from the ground, a generally vertically extending back supporting surface, and means for selectively increasing the vertical extent of the back supporting surface, and means connecting the backrest to the seat for relative pivotal movement about a generally horizontal axis.

One embodiment of the invention provides a chair comprising a seat having an upper surface, a backrest including a forwardly facing body supporting surface, and means connecting the backrest to the seat for movement relative thereto about a generally horizontal axis and between a folded-up position wherein the upper surface of the seat and the body supporting surface of the backrest are substantially in abutment, and a seating position wherein the upper surface of the seat is transverse to the body supporting surface of the backrest, the means including, in one of the seat and the backrest, a recess which forms a notch having an end and which is defined by a wall having therein an opening at the end of the notch, and the means also including, on the other of the seat and the backrest, a post which extends along the axis, which extends into the recess, which is located in the notch when the backrest is in the seating position, and which has thereon a tab that extends into the opening when the post is properly located in the notch.

One embodiment of the invention provides a chair comprising a seat having an upper surface and a lower surface portion, a backrest including a forwardly facing body supporting surface and a rear surface, and means connecting the backrest to the seat for pivotal movement relative thereto about a generally horizontal axis and to a folded-up position wherein the upper surface of the seat and the body supporting surface of the backrest are substantially in abutment, and wherein the lower surface portion of the seat and the rear surface of the backrest are substantially in abutment, and the means also connecting the backrest to the seat for movement to a seating position wherein the upper surface of the seat is transverse to the body supporting surface of the backrest, the lower surface portion of the seat extending rearwardly of the axis when the backrest is in the seating position.

One embodiment of the invention provides a chair comprising a seat having a forward end and an integrally formed rear leg part, a backrest including a generally vertically extending back supporting surface, and an integrally formed front leg part cooperating with the rear leg part of the seat to support the chair from the ground, means connecting the backrest to the seat for relative pivotal movement about a generally horizontal axis, and second means operable in the event of disengagement of the connecting means for substantially preventing downward movement of the forward end of the seat relative to the front leg part of the backrest.

Other features and advantages of the invention will become apparent to those of ordinary skill in the art upon review of the following detailed description, claims, and drawings.

Figure 1:
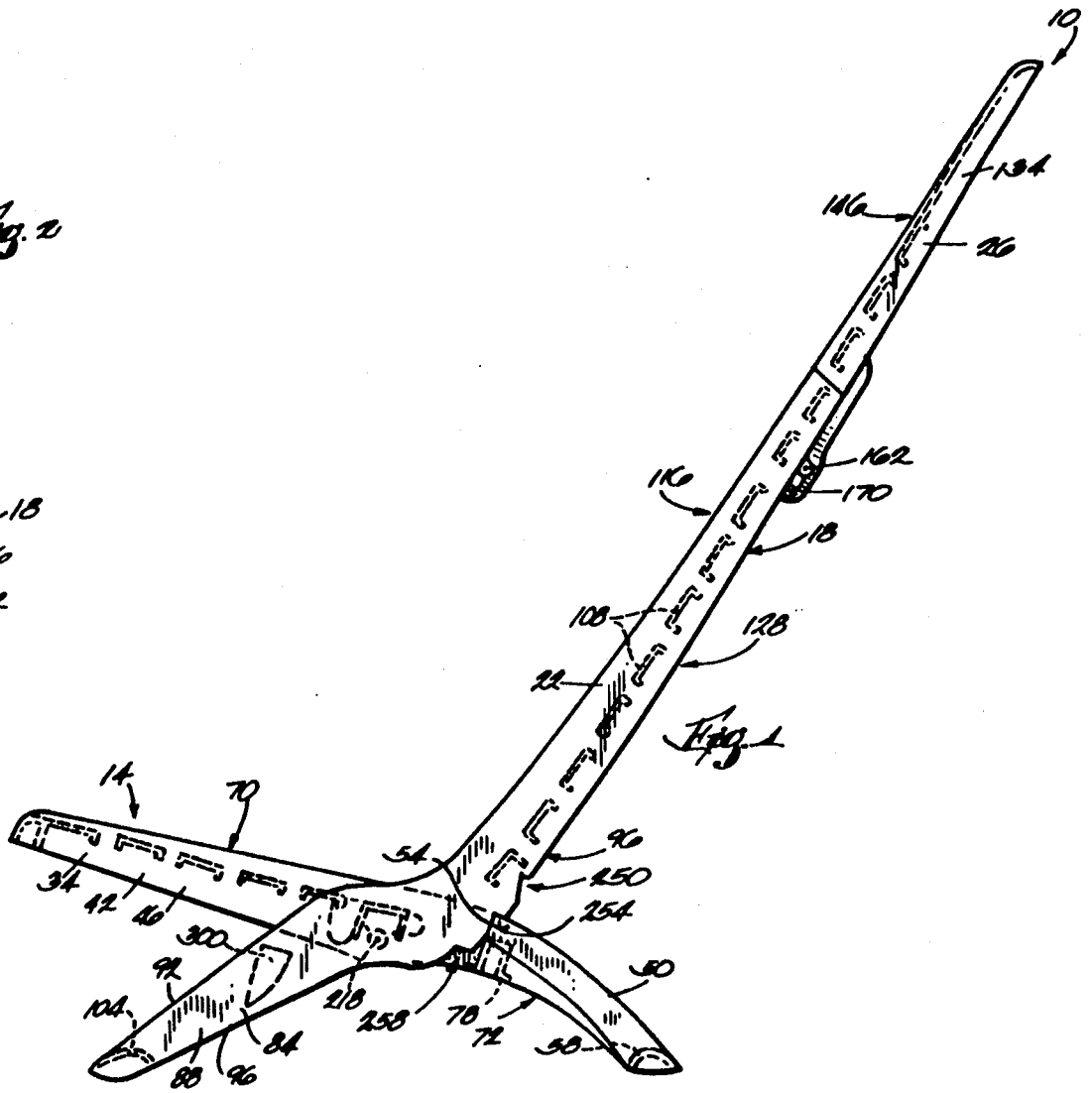
FIG. 1 is a side elevational view of a lounge chair embodying the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A lounge chair 10 embodying the invention is illustrated in the drawings. The chair 10 comprises (see FIGS. 1 and 2) a seat 14 and a backrest 18, both of which are preferably made of injection-molded plastic. The backrest 18 includes first and second or lower and upper portions 22 and 26 that are molded separately.

Figure 3:
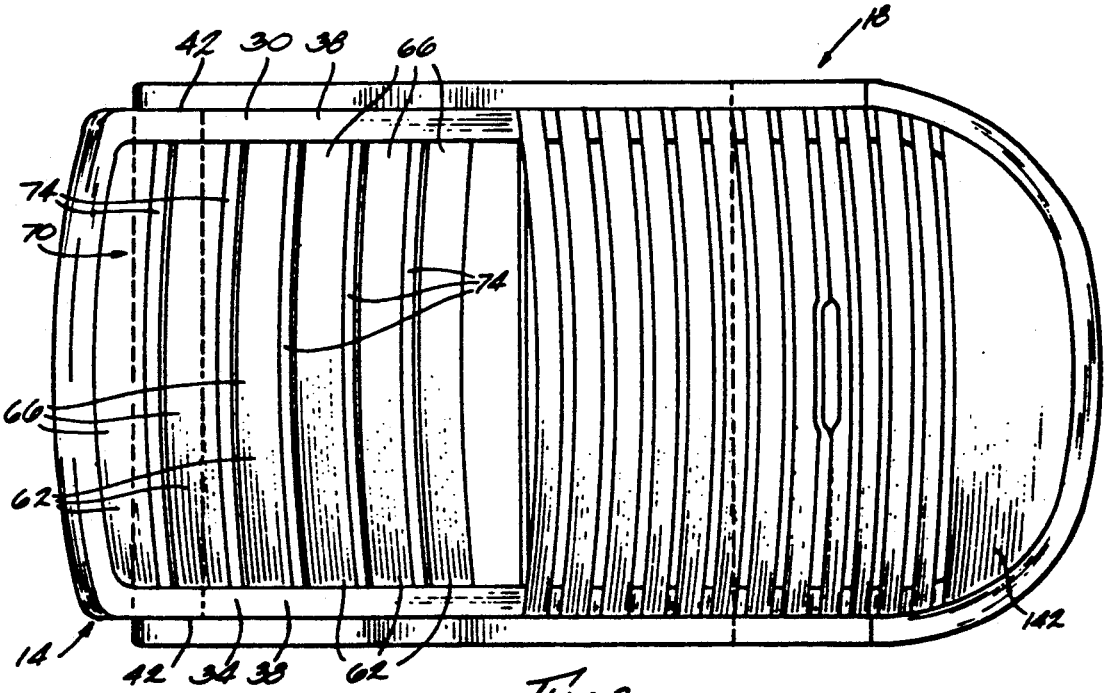
FIG. 3 is a top plan view of the chair.
Figure 4:
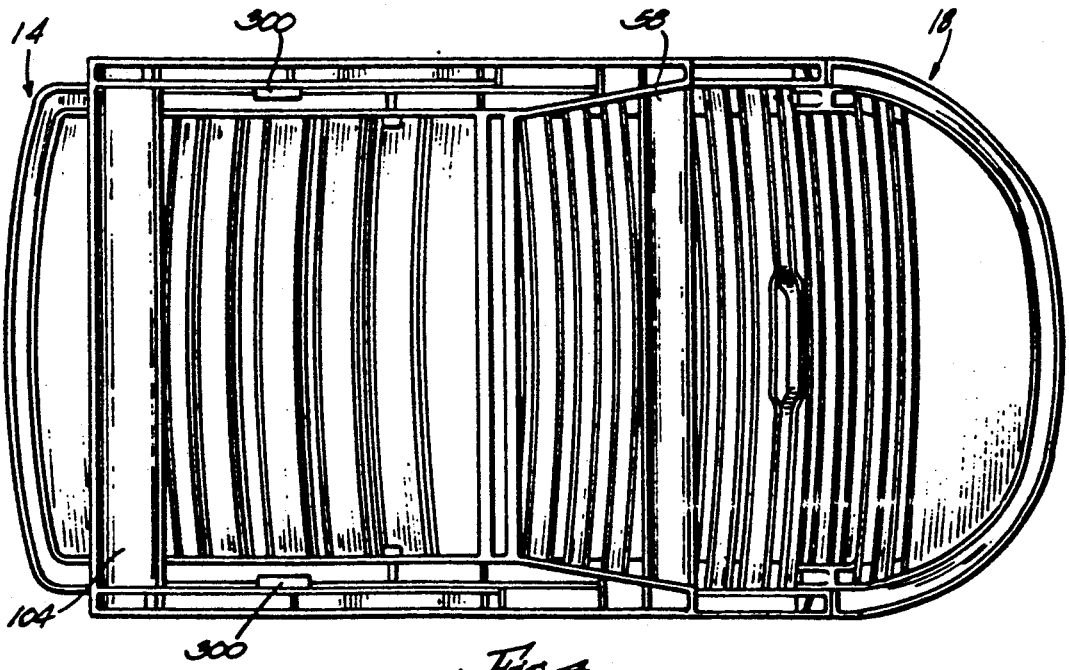
FIG. 4 is a bottom plan view of the chair.

The seat 14 includes (see FIGS. 3 and 6) parallel, spaced-apart side members 30 and 34 having respective forward and rearward ends. Each of the side members 30 and 34 has an upper surface 38 and an outer surface 42. The outer surface 42 has (see FIGS. 1 and 9) parallel, offset portions 46 and 50 defining therebetween a forwardly facing shoulder 54. The seat 14 also includes a rear cross member 58 extending between the rearward ends of the side members 30 and 34 and cooperating with the rearward ends of the side members 30 and 34 to form an integral rear leg part of the seat 14. The seat 14 further includes (see FIG. 3) a plurality of cross members 62 extending between the side members 30 and 34 and having respective upper surfaces 66 cooperating with the upper surfaces 38 of the side members 30 and 34 to define an upper surface 70 of the seat 14. The seat 14 also has a lower surface portion 72 As shown in the drawings, the cross members 62 are spaced apart to define therebetween elongated openings 74 in the upper surface 70 of the seat 14. The seat 14 also includes a support member 78 extending between the side members 30 and 34.

The first or lower portion 22 of the backrest 18 includes parallel, spaced-apart side members 80 and 84. Each of the side members 80 and 84 has upper and lower ends, an outer surface 88, a front surface 92, a rear surface 96, and an inner surface 100. The inner and outer surfaces 100 and 88 are generally planar and parallel. The front and rear surfaces 92 and 96 include offset upper and lower portions, as best shown in FIG. 1. The lower backrest portion 22 also includes a lower cross member 104 extending between the lower ends of the side members 80 and 84 and cooperating with the lower ends of the side members 80 and 84 to form an integral front leg part of the backrest 18. The lower backrest portion 22 further includes (see FIGS. 2 and 6) a plurality of cross members 103 extending between the side members 80 and 84 and having respective front surfaces 112 cooperating with the front surfaces 92 of the side members 80 and 84 to define a forwardly facing lower body supporting surface 116 of the lower backrest portion 22. The cross members 108 are spaced apart to define therebetween a plurality of elongated openings 120 in the lower body supporting surface 116 of the lower backrest portion 22. The cross members 108 also have (see FIG. 5) respective rear surfaces 124 cooperating to define a rear surface 128 of the lower backrest portion 22. The uppermost cross member 108 and the upper ends of the side members 80 and 84 define the upper end of the lower backrest portion 22.

Figure 2:
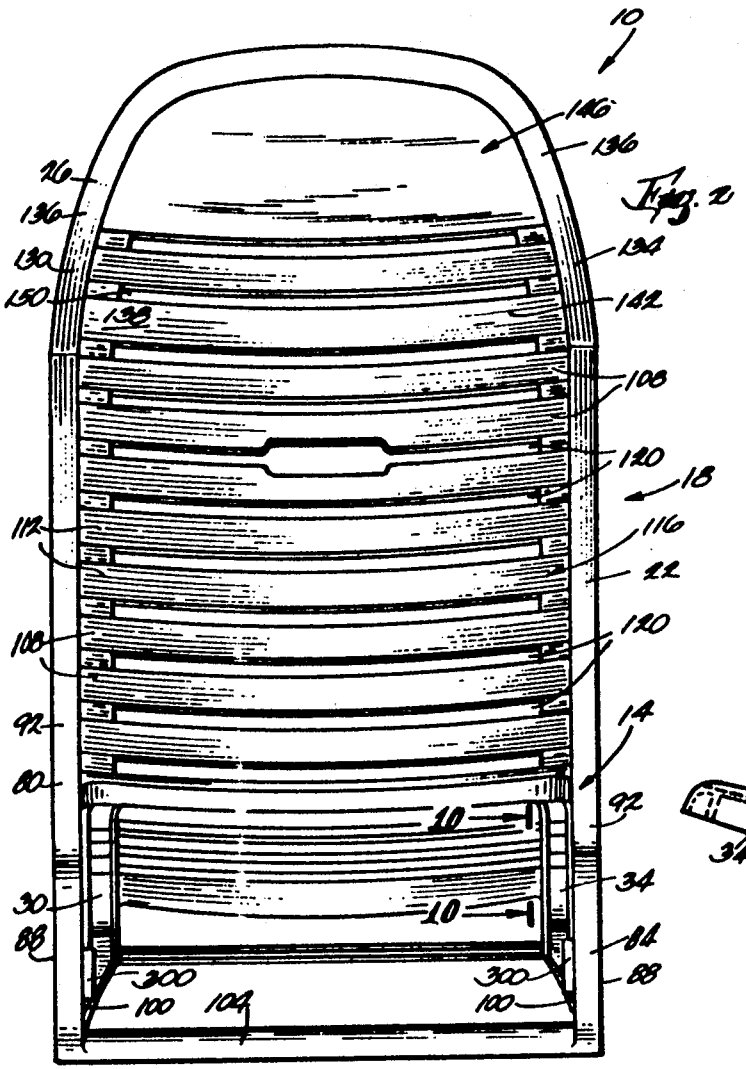
FIG. 2 is a front elevational view of the chair.
Figure 6:
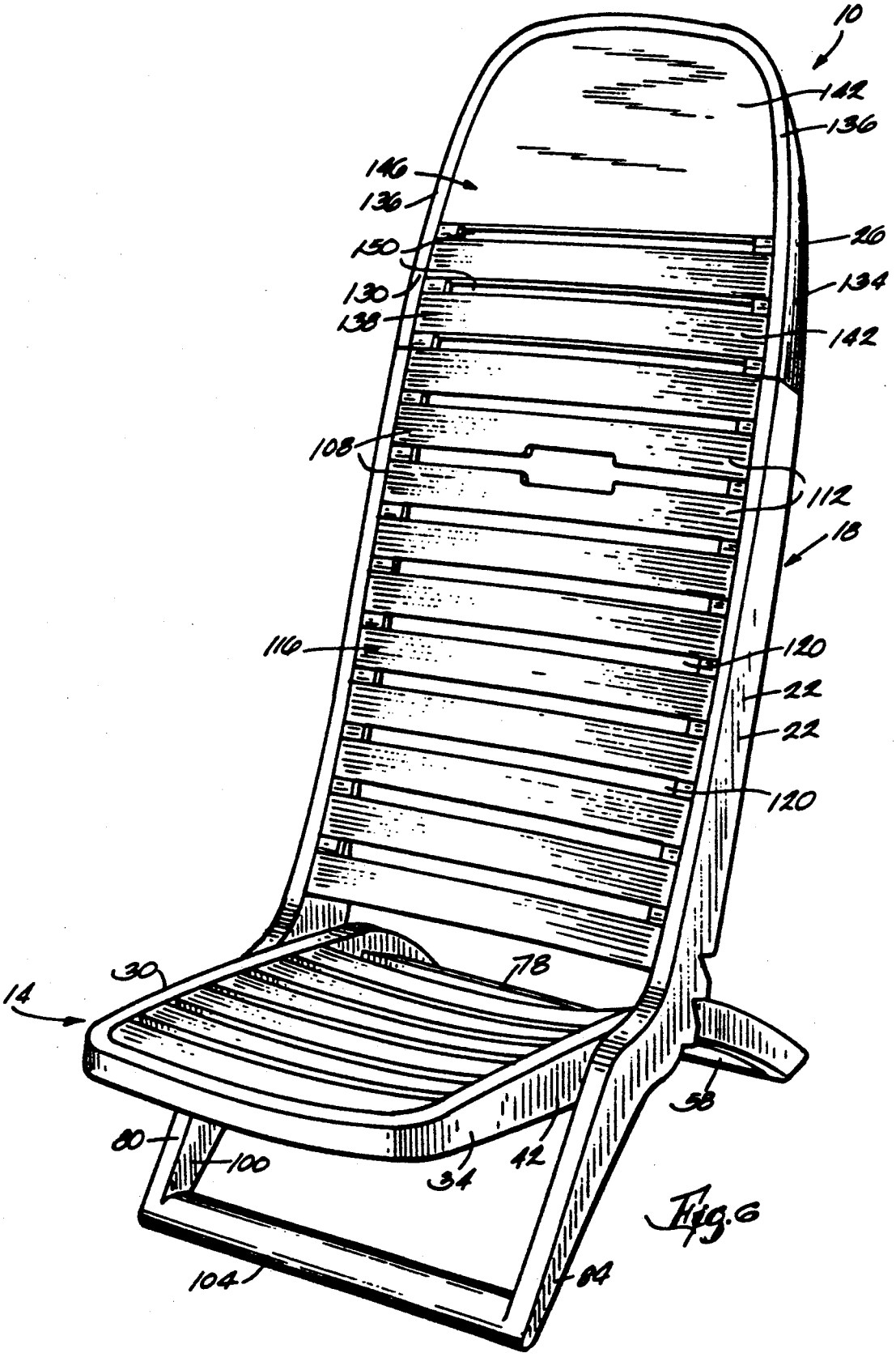
FIG. 6 is a perspective view of the chair.

The second or upper portion 26 of the backrest 18 includes upwardly converging, spaced-apart side members 130 and 134 having respective front surfaces 136 and upper and lower ends. The upper backrest portion 26 also includes a plurality of cross members 138 extending between the side members 130 and 134 and having respective front surfaces 142 cooperating with the front surfaces 136 of the side members 130 and 134 to define an upper body supporting surface 146 of the upper backrest portion 26. The cross members 138 are spaced apart to define therebetween a plurality of elongated openings 150 in the upper body supporting surface 146 of the upper backrest portion 26. The cross members 138 also have (see FIG. 5) respective rear surfaces 154 cooperating to define a rear or opposite surface 158 of the upper backrest portion 26. The lowermost cross member 138 and the lower ends of the side members 130 and 134 define the lower end of the upper backrest portion 26. The uppermost cross member 138 and the upper ends of the side members 130 and 134 define the upper end of the upper backrest portion 26. As shown in FIGS. 2 and 6, the uppermost cross member 138 preferably has a vertical dimension substantially greater than the vertical dimensions of the other cross members 138 so that the uppermost cross member 138 forms a headrest.

The chair 10 also comprises means connecting the lower end of the upper backrest portion 26 to the upper end of the lower backrest portion 22 for movement relative thereto between a locked position (shown in FIGS. 1, 2, 12 and 15) wherein the upper and lower body supporting surfaces 146 and 116 are generally coplanar or contiguous, and a folded-up position (shown in FIGS. 9 and 14) wherein the rear surface 128 of the lower backrest portion 22 and the rear surface 158 of the upper backrest portion 26 are substantially in abutment. While various suitable connecting means can be employed, in the preferred embodiment, such means includes means connecting the lower end of the upper backrest portion 26 to the upper end of the lower backrest portion 22 for translational or generally vertical movement of the upper backrest portion 26 relative to the lower backrest portion 22 between the locked position and an intermediate position (shown in FIGS. 13 and 17) spaced upwardly from the locked position, and for pivotal movement of the upper backrest portion 26 relative to the lower backrest portion 22 about a generally horizontal axis 162 (see FIGS. 13 and 14) and between the intermediate position and the folded-up position.

Figure 5:
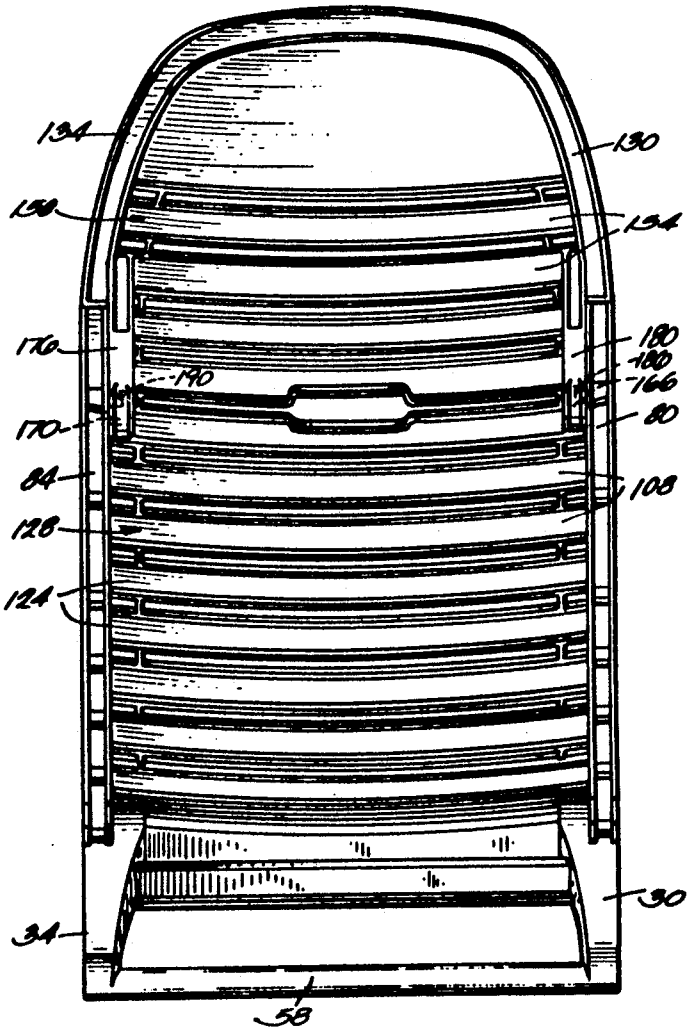
FIG. 5 is a rear elevational view of the chair.
Figure 12:
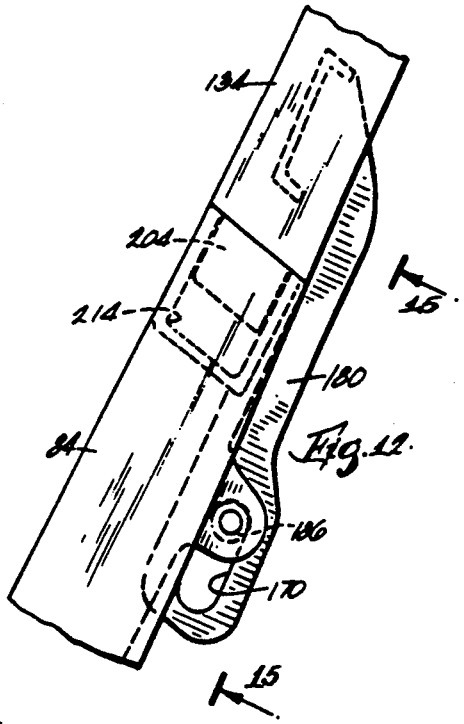
FIG. 12 is an enlarged portion of FIG. 1.
Figure 14:
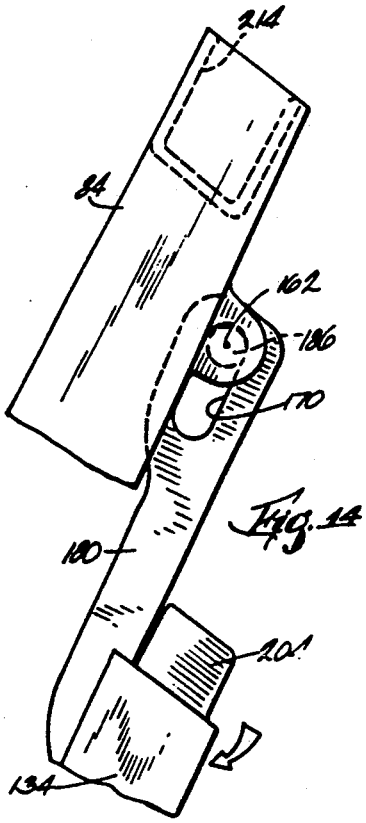
FIG. 14 is a view similar to FIG. 12 with the upper backrest portion in folded-up position.
Figure 13:
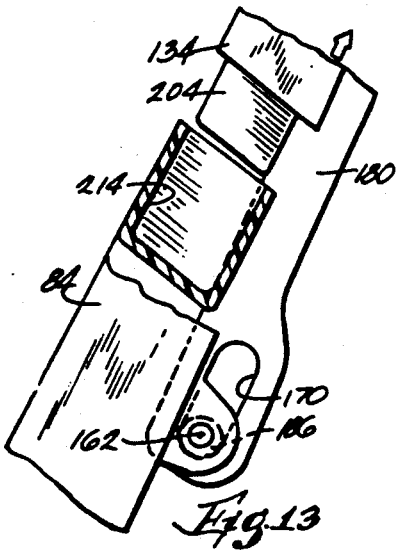
FIG. 13 is a view similar to FIG. 12 with the upper backrest portion in the intermediate position.

In the preferred embodiment, the connecting means includes, on the upper backrest portion 26, means defining (see FIG. 5) a pair of spaced-apart slots 166 and 170 which extend generally vertically (or parallel to the upper body supporting surface 146) when the upper backrest portion 26 is in the locked position. The slots 166 and 170 have respective upper and lower ends. The slot 166 is defined (see FIG. 5) by a projection 180 extending downwardly from the lower end of the side member 130, and the slot 170 is defined by a projection 176 extending downwardly from the lower end of the side member 134. The connecting means also includes, on the lower backrest portion 22, a hinge pin or post 186 extending along the axis 162 and into the slot 166, and a hinge pin or post 190 (FIG. 5) extending along the axis 162 and into the slot 170. The projections 176 and 180 are located inwardly of the side members 80 and 84 of the lower backrest portion 22, as shown in FIG. 5, and the hinge pins 186 and 190 extend inwardly from the side members 80 and 84 and into the slots 166 and 170. As shown in FIGS. 12–14, the diameter of each pin 186 and 190 is substantially less than the length of the associated slot 166 or 170, so that the pins 186 and 190 can both pivot in the slots 166 and 170 and move translationally in the slots 166 and 170.

Figure 17:
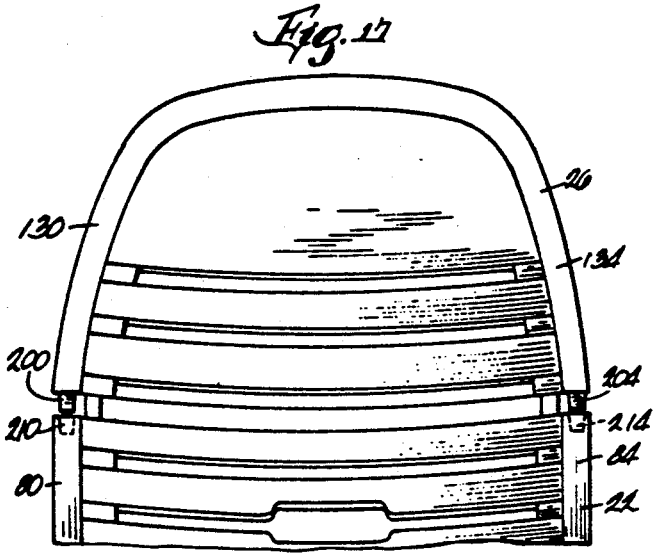
FIG. 17 is an enlarged portion of FIG. 2 with the upper backrest portion intermediate position.
Figure 15:
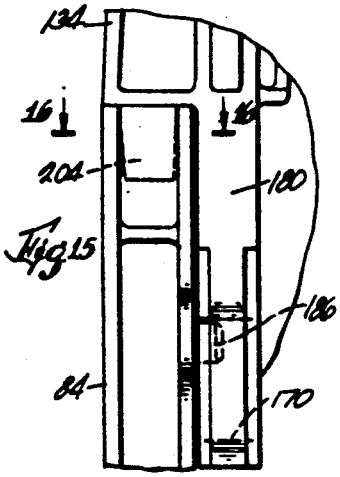
FIG. 15 is a view taken along line 15—15 in FIG. 12.
Figure 16:
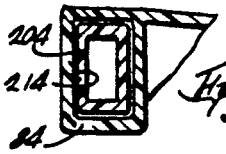
FIG. 16 is a view taken along line 16—16 in FIG. 15.

The backrest 18 also includes means for releasably retaining the upper backrest portion 26 in the locked position. While various suitable retaining means can be employed, in the preferred embodiment, such means includes (see FIG. 17) projections 200 and 204 on the lower ends of the upper backrest portion side members 130 and 134, and recesses 210 and 214 in the upper ends of the lower backrest portion side members 80 and 84. When the upper backrest portion 26 is in the locked position, as shown in FIGS. 12, 15 and 16, the projections 200 and 204 are located in the recesses 210 and 214 and prevent pivotal movement of the upper backrest portion 26 relative to the lower backrest portion 22. When the upper backrest portion 26 is in the intermediate position, as shown in FIGS. 13 and 17, the projections 200 and 204 are removed from the recesses 210 and 214 and permit pivotal movement of the upper backrest portion 26 relative to the lower backrest portion 22.

Figure 9:
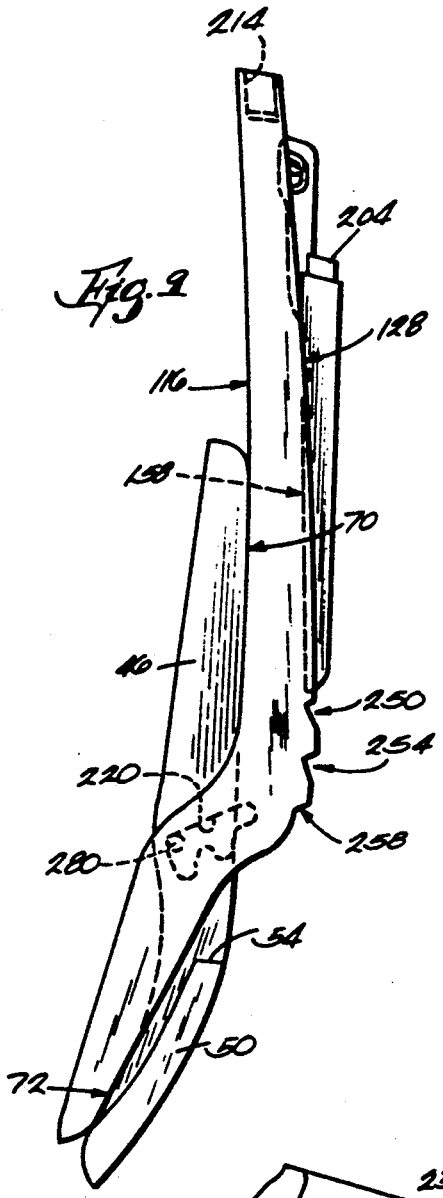
FIG. 9 is a side view of the chair folded up.

When the backrest is folded up, as shown in FIGS. 9 and 14, the pins 186 and 190 are located in the lower ends of the slots 166 and 170 and the rear surface of the upper backrest portion 26 abuts the rear surface of the lower backrest portion 22. The upper backrest portion 26 is moved to the locked position as follows. First, the upper backrest portion is pivoted about the axis 162 and from the folded-up position to the intermediate position (shown in FIGS. 13 and 17). During such pivotal movement of the upper backrest portion 26, the pins 186 and 190 remain in the lower ends of the slots 166 and 170 and rotate within the slots 166 and 170. Next, the upper backrest portion 26 is moved downwardly from the intermediate position to the locked position (shown in FIGS. 12 and 15). During such downward movement of the upper backrest portion 26 the pins 186 and 190 move from the lower ends of the slots 166 and 170 to the upper ends of the slots 166 and 170 and the projections 200 and 204 move into the recesses 210 and 214.

The chair 10 further comprises means connecting the lower backrest portion 22 to the seat 14 for pivotal movement relative thereto about a generally horizontal axis 218. The lower backrest portion 22 is pivotable relative to the seat 14 between a folded-up position (shown in FIG. 9) wherein the upper surface of the seat 14 and the lower body supporting surface 116 of the lower backrest portion 22 are substantially in abutment and the lower surface portion 72 of the seat 14 and the rear surface 96 of the lower backrest portion 22 are substantially in abutment, and at least three seating positions (shown in FIGS. 1, 7 and 8) wherein the upper surface of the seat 14 is transverse to the lower body supporting surface 116 of the lower backrest portion 22. The chair 10 further comprises means for securing the lower backrest portion 22 in each of the seating positions. The means for connecting the seat 14 and the lower backrest portion 22 and for securing the lower backrest portion 22 in the seating positions preferably includes interengaging means on the seat 14 and on the lower backrest portion 22.

Figure 18:
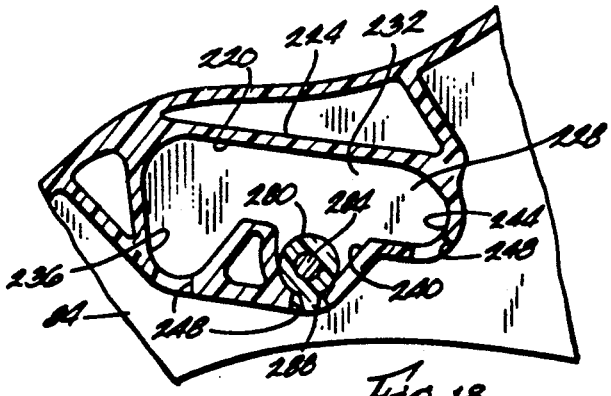
FIG. 18 is a view taken along line 18—18 in FIG. 11.
Figure 11:
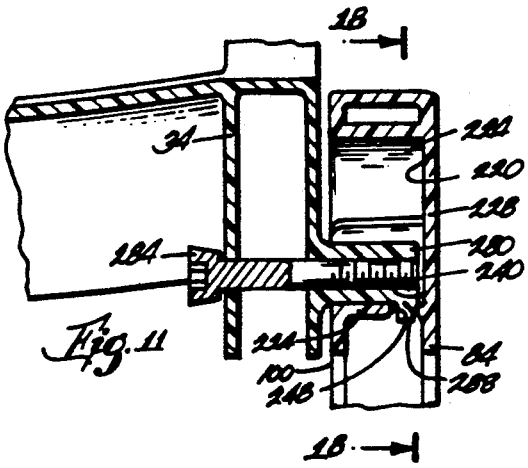
FIG. 11 is a view taken along line 11—11 in FIG. 10.
Figure 10:
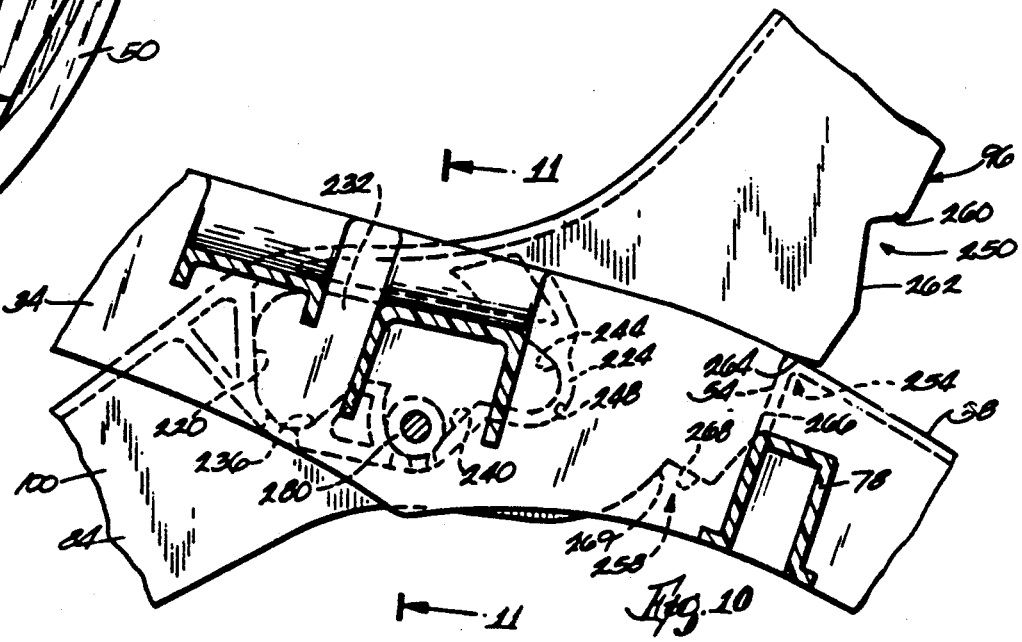
FIG. 10 is an enlarged view taken along line 10—10 in FIG. 2.

While various suitable interengaging means can be used, in the illustrated construction, the interengaging means includes (see FIGS. 10, 11 and 18), in the inner surface 100 of each of the side members 80 and 84 of the lower backrest portion 22, a track or recess 220. Each recess 220 is defined by (see FIG. 18) an endless side wall 224 extending perpendicular to the inner wall 100, and by an end wall 228 parallel to the inner wall 100. The side wall 224 is shaped so as to provide the recess 220 with an elongated, generally straight section 232 that extends generally horizontally and that has opposite left and right (as shown in FIGS. 10 and 18) or front and rear ends. The recess 220 also includes a notch or depression 236 extending downwardly from the left end of the straight section 232, and a notch or depression 240 extending downwardly from approximately the middle of the straight section 232. The right end of the straight section 232 defines a third notch or depression 244. As shown in FIGS. 10, 11 and 18, the side wall 224 has therein, at the end of each of the notches 236, 240 and 244, an opening 248. The reason for the openings 248 is explained below. The interengaging means also includes (see FIGS. 1 and 11), on the rear surface 96 of each of the side members 80 and 84 of the lower backrest portion 22, a "saw-tooth" arrangement providing upper, middle and lower notches 250, 254 and 258. The upper notch 250 is defined by a generally downwardly facing surface 260 and by a generally rearwardly facing surface 262 The middle notch 254 is defined by a generally downwardly facing surface 264 and by a generally rearwardly facing surface 266. The lower notch 258 is defined by a generally downwardly facing surface 268 and by a generally rearwardly facing surface 269.

Figure 7:
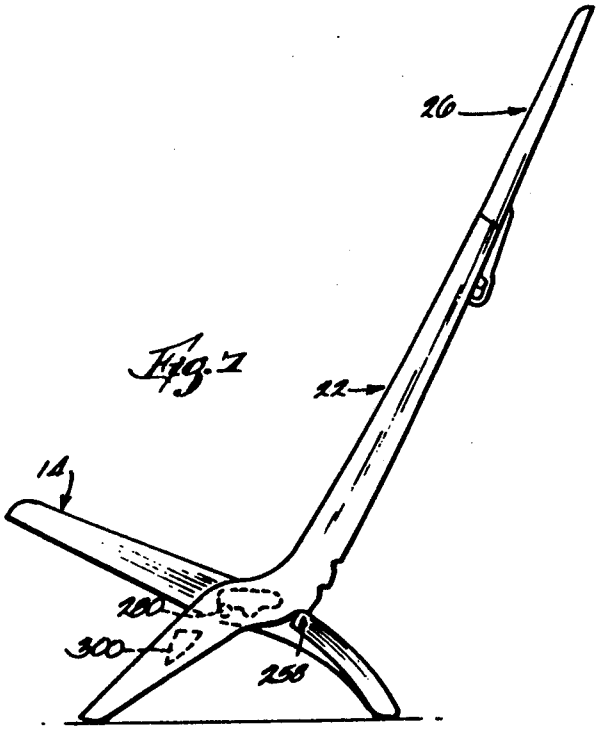
FIG. 7 is a view similar to FIG. 1 showing the backrest in a second seating position.
Figure 8:
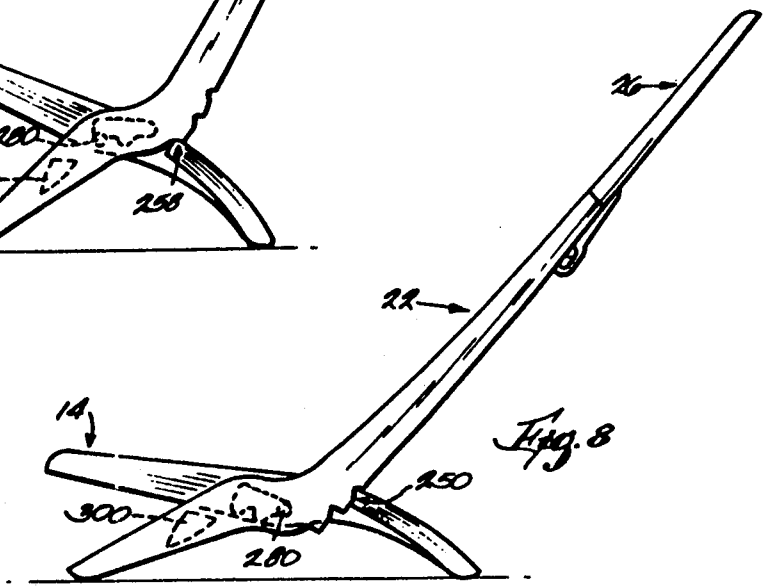
FIG. 8 is a view similar to FIG. 1 showing the backrest in a third seating position.

The interengaging means also includes (see FIGS. 10–12), on the outer surface 42 of each of the side members 30 and 34 of the seat 14, an outwardly extending post or projection 280 extending along the axis 218. In order to rigidify the posts 280, a bolt or screw 284 extends through each of the side members 30 and 34 and is threaded into the associated post 280. As shown in FIG. 11, each post 280 has thereon, adjacent its outer end, a generally downwardly facing tab 288. The post 280 on the seat side member 30 extends into the recess 220 in the side member 80 of the lower backrest portion 22, and the post 280 on the seat side member 34 extends into the recess 220 in the side member 84 of the lower backrest portion 22. As shown in FIGS. 7–10, each post 280 can be located in any of four different positions within the associated recess 220. More particularly, each post 280 can be located in any one of the three notches 236, 240 and 244 (as shown in FIGS. 7, 8 and 10) or at the forward end of the straight section 232 (as shown in FIG. 9). The interengaging means further includes the upper surface 38 and the shoulder 54 of each of the seat side members 30 and 34.

When the seat 14 is in its folded-up position, as shown in FIG. 9, the posts 280 are located at the forward ends of the straight sections 232 of the recesses 220. The seat 14 does not engage any of the notches 250, 254, and 258 in the lower backrest portion 22. When the seat 14 is in a first seating position, as shown in FIGS. 1, 10 and 11, the posts 280 are located in the middle notches 240 of the recesses 220, and the tabs 288 on the posts 280 extend into the openings 248 in the side walls 224. Location of the tabs 288 in the openings 248 provides a tactile indication to the user that the posts 280 are properly located in their respective notches and also resists withdrawal of the posts 280 from the notches. Also, when the seat 14 is in the first seating position, the seat 14 engages the middle notch 254 in the lower backrest portion 22. Specifically, the upper surfaces 38 of the seat side members 30 and 34 engage the middle surfaces 264 of the lower backrest portion side members 80 and 84, and the shoulders 54 of the seat side members 30 and 34 engage the middle surfaces 266 of the lower backrest portion side members 80 and 84. When the seat 14 is in a second seating position, as shown in FIG. 7, the posts 280 are located in the front notches 236 of the recesses 220, and the tabs 288 extend into the openings 248. Also, the seat 14 engages the lower notch 258 in the lower backrest portion 22. Specifically, the upper surfaces 38 of the seat side members 30 and 34 engage the lower surfaces 268 of the lower backrest portion side members 80 and 84, and the shoulders 54 of the seat side members 30 and 34 engage the lower surfaces 269 of the lower backrest portion side members 80 and 84. When the seat 14 is in a third seating position, as shown in FIG. 8, the posts 280 are located in the rear notches 244 of the recesses 220 and the tabs 288 extend into the openings 248. Also, the seat 14 engages the upper notch 250 in the lower backrest portion 22. Specifically, the upper surfaces 38 of the seat side members 30 and 34 engage the upper surfaces 250 of the lower backrest portion side members 80 and 84, and the shoulders 54 of the seat side members 30 and 34 engage the upper surfaces 252 of the lower backrest portion side members 80 and 84. In each of the seating positions, the combination of the interengagement of the posts 280 and the notches 236, 240 or 244 and the interengagement of the seat side members 30 and 34 and the lower backrest portion side members 80 and 84 prevents pivotal movement of the lower backrest portion 22 in the clockwise direction (as shown in FIGS. 1, 7 and 8) relative to the seat 14.

The entire chair 10 can be folded up so that the chair 10 is easily transported and stored. The chair 10 is folded up by placing the upper backrest portion 26 in its folded-up position and by placing the seat 14 in its folded-up position. Detent means (not shown) can be provided on the seat 14 and on the backrest 18 for releasably retaining the seat 14 in its folded-up position.

The chair 10 further comprises means operable in the event of disengagement of either post 280 and the associated recess 220 for substantially preventing downward movement of the forward end of the seat 14 relative to the lower backrest portion 22. This means preferably includes (see FIGS. 1, 2, 4, 7 and 8), on the inner surface 100 of each of the lower backrest portion side members 80 and 84, an inwardly extending projection 300 located closely adjacent and beneath the associated seat side member 30 or 34. In the unlikely event either seat side member 30 or 34 moves inwardly such that the associated post 280 comes out of the associated recess 220, the seat side member 30 or 34 will immediately engage the upper surface of the associated projection 300 and will thereby be substantially prevented from moving further downwardly relative to the associated lower backrest portion side member 80 or 84. This is a safety feature that could, under certain circumstances, prevent a user's finger from being caught between the bottom of the seat 14 and the lower backrest portion 22.

Various features of the invention are set forth in the following claims.

I claim:

1. A chair comprising a seat having an integrally formed leg part, a backrest including an integrally formed leg part cooperating with said leg part of said seat to support said chair from the ground, a generally vertically extending back supporting surface, a first portion having thereon said leg part of said backrest and a first surface defining a portion of said back supporting surface, and a second portion including a second surface defining a portion of said back supporting surface, wherein said seat is connected to said first portion of said backrest, and means for selectively increasing the vertical extent of said back supporting surface, said extent increasing means comprising means connecting said second portion to said first portion for relative pivotal movement about a second generally horizontal axis and relative to a first position wherein said second surface is contiguous with said first surface, and means for releasably retaining said second portion in said first position, said retaining means comprising a projection on one of said first and second portions and a recess in the other of said first and second portions, said connecting means further providing means for translational movement of said second portion relative to said first portion, whereby said projection can be inserted into and removed from said recess, and means connecting said backrest to said seat for relative pivotal movement about a generally horizontal axis.

2. A chair in accordance with claim 1 wherein said projection extends parallel to said first surface when said second portion is in said first position.

3. A chair in accordance with claim 1 wherein said retaining means also comprises a second projection on said one of said first and second portions and a second recess in said other of said first and second portions.

4. A chair in accordance with claim 1 wherein said connecting means comprises, in said second portion, first and second slots, and, on said first portion, first and second spaced apart hinge posts extending along the horizontal axis and respectively extending into said first and second slots.

5. A chair comprising a seat having a forward end, spaced first and second side members, and an integrally formed rear leg part, a backrest including a generally vertically extending back supporting surface, an integrally formed front leg part cooperating with said rear leg part of said seat to support said chair from the ground, and spaced first and second side members having respective inner surfaces, said seat side members extending between said inner surfaces of said backrest side members, means connecting said backrest directly to said seat for relative pivotal movement about a generally horizontal axis, and second means operable only in the event of disengagement of said connecting means for substantially preventing downward movement of said forward end of said seat relative to said front leg part of said backrest, said second means including, on said inner surface of said first backrest side member, an inwardly extending first projection located closely adjacent and beneath said first seat side member, and, on said inner surface of said second backrest side member, an inwardly extending second projection located closely adjacent and beneath said second seat side member.

6. A chair as set forth in claim 5 wherein said first projection has an inner end connected to said first side member and has an outer end, and wherein said second projection has an inner end connected to said second side member and has an outer end spaced from said outer end of said first projection.

* * * * *